United States Patent [19]

Weickert et al.

[11] Patent Number: 4,641,581

[45] Date of Patent: Feb. 10, 1987

[54] DUAL-FUNCTION STORAGE CONTAINER FOR PRILLED EXPLOSIVE

[75] Inventors: Chris A. Weickert, Ralston; Gordon K. Briosi, Medicine Hat, both of Canada

[73] Assignee: Her Majesty the Queen in right of Canada, as represented by the Minister of National Defence, Ottawa, Canada

[21] Appl. No.: 653,110

[22] Filed: Sep. 21, 1984

[30] Foreign Application Priority Data

Sep. 23, 1983 [CA] Canada ..... 437390

[51] Int. Cl.[4] ..... F42B 1/02

[52] U.S. Cl. ..... 102/307; 102/315; 102/309; 102/331; 102/332

[58] Field of Search ..... 102/306, 307, 310, 315, 102/331, 309, 332

[56] References Cited

U.S. PATENT DOCUMENTS

| | | | |
|---|---|---|---|
| 3,165,057 | 1/1965 | Armstrong | 102/307 |
| 3,311,324 | 3/1967 | Holt et al. | 102/307 X |
| 3,371,605 | 3/1968 | Eckels | 102/307 X |
| 4,099,464 | 7/1978 | Cross et al. | 102/331 |
| 4,109,576 | 8/1978 | Eckels | 102/307 |
| 4,498,367 | 2/1985 | Skolnick et al. | 102/306 X |
| 4,499,828 | 2/1985 | Honodel | 102/306 X |

FOREIGN PATENT DOCUMENTS

| | | | |
|---|---|---|---|
| 2745469 | 12/1982 | Fed. Rep. of Germany | 102/307 |

*Primary Examiner*—Peter A. Nelson

*Attorney, Agent, or Firm*—Anthony T. Lane; Robert P. Gibson; Edward F. Costigan

[57] ABSTRACT

Disclosed is a low cost bulk explosive storage container constructed in such a way that simple on-site modifications, specifically the attachment of a metal liner and the addition of a fluid will transform the carrying container into a directed energy demolition device.

11 Claims, 3 Drawing Figures

DUAL-FUNCTION STORAGE CONTAINER FOR PRILLED EXPLOSIVE

Figure 1:
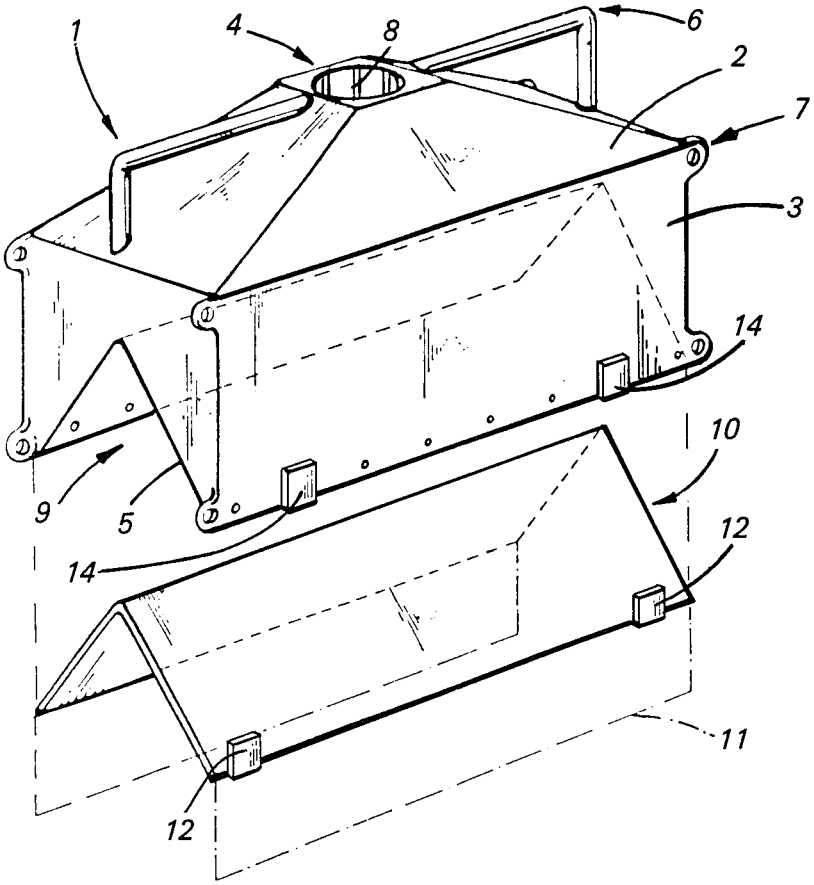

This invention relates to explosive containers and more particularly a container which can be used as a directed energy demolition device (an expedient shaped charge).

One military purpose of demolition is to create a coordinated series of obstacles designed or employed to canalize, direct, restrict, delay or stop the movement of opposing military forces. Demolition tasks are generally a military engineer's responsibility. Limited engineering resources, time and shortages could restrict the number and extent of planned demolitions. With respect to munitions, the amount of explosive available for demolition tasks may be limited by the carrying capacity of men and fighting vehicles (or, in some cases, aircraft).

In certain environments engineers may be responsible for a variety of demolition tasks, such as cutting structural members to induce structural collapse, breaching holes in walls, and creating pilot holes for mined charges or cratering tasks (boreholes which can be loaded with explosive) and demolition of bridge decks using large contact charges.

The current demolition techniques employ either (1) plastic explosive (cutting and breaching) in direct contact with the target (or in boreholes created by a variety of cylindrical shaped charges) or (2) shaped demolition charges. Generally, these shaped charges are pre-manufactured in explosive-filled metal containers which may include either a metal or glass internal liner. Typically, different shaped charges are employed to accomplish specific goals. "Hayricks" (a form of linear shaped charge) are often employed to cut steel I beams. A linear charge includes a rectangular shaped bottom section with a pyramid shaped top and a wedge-shaped recess in the base, and will cut a linear hole in the object near which it is placed. A cylindrical charge with a conically-shaped top and a conical recess in the base will create a circular hole in the object near which it is placed. This type of device is known as an axi-symmetric shaped charge or "Beehive". Contact charges are not generally as effective as shaped charges for cutting or penetrating targets.

A shaped charge is an explosive charge so shaped that the energy of the explosive, released upon detonation, is concentrated in a small area. The effectiveness of the shaped charge is due to the energy being directed to produce a piercing jet from the base of the charge. The depth of penetration of the shaped charge "jet" will be greatest at the optimum standoff distance. The standoff distance allows the jet to form fully and focus the energy. The use of a standoff distance and a cavity liner will enhance the shaped charge performance due to more efficient concentration of energy, however the use of standoff is not essential.

For the linear cutting charge zero standoff is used for operational reasons in some cases rather than scientific or technical reasons (for example in contact with the flanges of an "I" beam, but when used to cut the web, would typically employ some standoff distance). Standoff distance would typically be used in the axi-symmetric borehole producing charge.

Shaped charges currently available commercially are precision pre-filled at the factory making them more expensive.

A free-flowing prilled explosive known as "TRIGRAN" is used by the Canadian Forces for explosive excavation. It is described in Canadian Pat. No. 1,058,882, issued the 24th of July 1979, naming as co-inventors Sterling, Belanger and Thomas. TRIGRAN is an excellent military cratering explosive and it is produced in a free-flowing prilled form to facilitate rapid loading of boreholes for cratering.

TRIGRAN is a trade name used by the Canadian Forces. TRIGRAN provides a free-flowing, high-density, water resistant explosive composition comprising 35–80% by weight TNT, 10–30% by weight aluminum, and 0–45% by weight RDX, in spheroidal prill form.

Prior to the introduction of TRIGRAN, plastic explosive contact charges were commonly used for both cutting charges and cratering charges. Plastic explosive is an excellent cutting charge and although it functions well as a cratering charge, cost and time considerations made its use in the cratering role less efficient than the use of TRIGRAN. In order to use TRIGRAN in a demolition charge role (since it is a cohesionless material), it would have to be contained. While it could be simply put into a container, and used as a contact or pressure charge, it would be more effective and efficient as a cutting or borehole charge if the energy, upon detonation, could be directed at the target using the shaped charge principle.

An object of this invention is to package a freeflowing prilled explosive in a light-weight low-cost plastic container designed so that the explosive-container combination will function as a shaped charge when required. That would make it more versatile in this regard.

Basically, the concept is to design a dual function carrying container in which to transport or store a free-flowing prilled explosive, which could be quickly and simply transformed into a low-cost demolition device(s) when required to permit effective use of such an explosive for other demolition tasks, ideally without requiring extra storage volume.

Accordingly, there is provided a storage container usable as a directed energy demolition device having container means of suitable light-weight plastic material including an upstanding side wall section, an open top section for filling said container means with a suitable explosive, closure means for closing said open top section, a closed bottom section having a shaped inward extension shaped to direct the energy released upon detonation of said explosive at a small area of a target material, liner means of a suitable metal material shaped to conform to the shape of said inward extension, said liner means being disposed externally of said container means, and detonating means for detonating said explosives in the area of said closure means.

Preferably, the use of TRIGRAN as the shaped charge explosive is contemplated. TRIGRAN includes voids associated with the near spherical prills. It is preferable to fill the voids with water or some other suitable fluid to displace the air between prills. The detonation velocity of the TRIGRAN-water mixture is higher than a TRIGRAN-air mixture. It will be appreciated that the use of TRIGRAN as the explosive is inessential to the invention in its broadest form.

Figure 2:
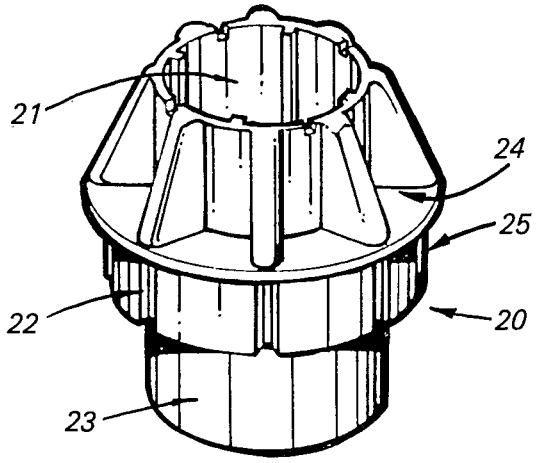

Particular embodiments of the invention will be described in conjunction with the accompanying drawings. FIG. 1 is a perspective view of a linear shaped storage container with wedge-shaped external metal liner according to one embodiment of the invention;

FIG. 2 is a perspective view of the closure cap; and

Figure 3:
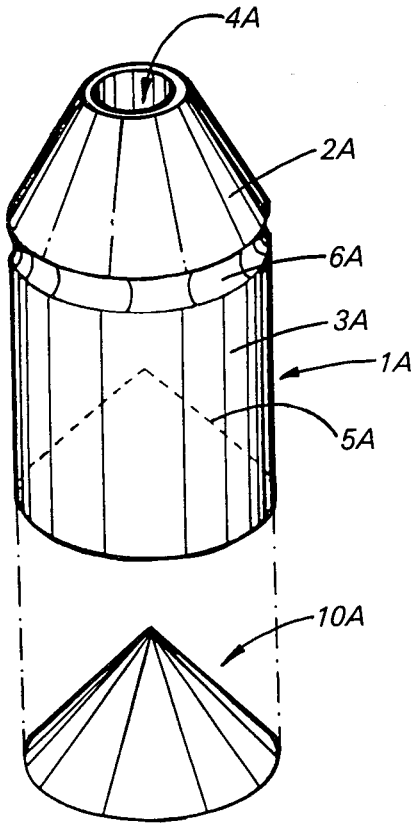

FIG. 3 is a perspective view of a conically shaped container and external liner according to another embodiment of the invention. Referring now to FIG. 1, a container of one embodiment of the invention is shown generally at 1. Reference numeral 2 indicates a pyramid shaped upper section and reference numeral 3 indicates an upstanding rectangular shaped lower section with a shaped inward extension in the form of inwardly angled walls 5 which define its bottom. The preferred angle formed by the walls is about 60°, although angles from 40° to over 90° have also been used. An inlet opening 4 is used for filling in the explosive and is provided with a plurality of guiding means 8 in the form of ribs on the inside walls of the inlet opening for receiving and retaining a closure cap shown generally as 20 in FIG. 2. In order to transform the storage container into a linear shaped charge, an external wedge-shaped metal liner 10 is placed under the container at the region indicated by numeral 9. The metal liner 10 can be held in place by snap-on clips 12 and 14 which can be attached either on the metal liner or on the container itself. Specifically, the metal liner 10 can be held in place by snap-on clips which can be attached either on the metal liner, as shown at 12 in FIG. 1, or in the container itself, as shown at 14 in FIG. 1. Preferably, the metal liner 10 includes a support base 11 to provide the appropriate stand-off distance from the target material. The container can easily be carried by utilizing the handles shown at 6. The handles 6 are shaped and placed on the upper section of the container so as to permit the stacking of several containers for ease of transportation and empty containers may be used for standoff. When the use of one shaped charge is not sufficient, then more than one container can be used. The containers can be attached together or tied down by utilizing the loops shown at 7. The loops 7 can also consist of a suitable linking mechanism such as holes in the container.

Referring now to FIG. 2, the cap is cylindrical in shape and consists of a diametrically larger upper section 25 and smaller diameter lower section 23. Slots 22 are provided on the outside surface of the diametrically larger upper section which are to mate with the guiding means 8 as shown previously in FIG. 1. This configuration restricts the rotational movement of the cap with respect to the container. Extended fins 24 are provided to increase rigidity and ease of handling for removal and installation of the cap. The cap includes a hollow interior portion to accommodate a detonating charge as shown at 21. The hollow cap can also be made of polyethylene plastic. It will be understood by those knowledgeable in the art that the slots and guiding means configuration 8 and 22 can also consist of cooperating threads.

FIG. 3 shows another embodiment of the invention. The container is shown generally as 1A. Reference numeral 2A indicates a conically shaped upper section and reference numeral 3A indicates a cylindrical upstanding lower section with a conical shaped inward extension 5A which defines its closed bottom. The addition of an external cone shaped metal liner 10A can be used to transform said container to a conical shaped charge. An appropriate stand-off distance from a target material can be provided by utilizing other containers of the same design, but empty. An inlet opening 4A is used for filling explosive and a hollow cap design as described in FIG. 2 is used to contain a detonating charge. A recessed groove 6A is incorporated into the conical upper section 2A to permit the stacking of several containers for ease of transportation and handling.

The metal liner is preferably made of steel, copper or aluminum, however other metals could be used as well. The container can be manufactured, for example by molding, from polyethylene plastic which would provide lightness and rigidity.

The embodiments of the invention in which an exclusive property or privilege is claimed are defined as follows:

1. A storage container for a particulate, pourable explosive, comprising:
   - a plastic container with top, side and bottom walls, the top wall including a filling opening and the bottom wall having a downwardly concave shape;
   - closure means for closing the filling opening;
   - a metal liner conforming in shape to the bottom wall of the container; and
   - fastening means for selectively fastening the metal liner to the outside of the bottom of the container.

2. A storage container according to claim 1, wherein the metal liner includes an elongated base extending, in use, from the bottom of the container thereby to provide a stand-off distance from a target material.

3. A storage container according to claim 1, wherein the bottom of the container is defined by inwardly angled walls and the metal container has a wedge shape conforming to the shape of the inwardly angled walls.

4. A storage container according to claim 3, wherein the inwardly angled walls form an angle of between 40° and 90°.

5. A storage container as defined in claim 4, wherein the inwardly angled walls form an angle of substantially 60°.

6. A storage container according to claim 1, wherein the bottom wall is substantially conical.

7. A storage container according to claim 1, wherein the top wall is configured to fit into the bottom of the concave bottom wall whereby the containers can be stacked.

8. A storage container according to claim 1, wherein the closure means comprise a cap with an opening in the center thereof adapted to receive a detonator.

9. A storage container according to claim 1, wherein the fastener means are carried by the liner.

10. A storage container according to claim 1, wherein the fastener means are carried by the container.

11. A storage container according to claim 1, in combination with a freeflowing pourable explosive filling the container.

* * * * *